US006456253B1

(12) United States Patent
Rümmeli et al.

(10) Patent No.: US 6,456,253 B1
(45) Date of Patent: Sep. 24, 2002

(54) REFLECTOR ANTENNA AND METHOD OF PRODUCING A SUB-REFLECTOR

(75) Inventors: Bernd Rümmeli, Strande (DE); Brian Scott, Norfork (GB)

(73) Assignee: RR Elektronische Geräte GmbH & Co. KG, Kiel (DE)

( * ) Notice: Subject to any disclaimer, the term of this patent is extended or adjusted under 35 U.S.C. 154(b) by 0 days.

(21) Appl. No.: 09/704,224

(22) Filed: Nov. 1, 2000

(30) Foreign Application Priority Data

Nov. 2, 1999 (DE) ..... 199 52 819

(51) Int. Cl.[7] ..... H01Q 19/10; H01Q 19/12
(52) U.S. Cl. ..... 343/839; 343/840; 343/781 CA
(58) Field of Search ..... 343/781 P, 781 R, 343/781 CA, 754, 755, 761, 758, 837, 839, 840; 29/600

(56) References Cited

U.S. PATENT DOCUMENTS 3,680,141 A * 7/1972 Karikomi ..... 343/758
4,305,075 A * 12/1981 Salvat et al. ..... 343/761
4,786,912 A * 11/1988 Brown et al. ..... 343/761
5,327,149 A * 7/1994 Kuffer ..... 343/720

* cited by examiner

*Primary Examiner*—Tan Ho
(74) *Attorney, Agent, or Firm*—Henry M. Feiereisen

(57) ABSTRACT

A reflector antenna is disclosed with a main reflector and a rotatable sub-reflector that significantly reduces vibrations in the sub-reflector. The sub-reflector includes a reflecting surface located in front of the main reflector between the main reflector and a radiation source as well as a cylindrical shaft that extends in a direction parallel to a main axis of the main reflector. The sub-reflector is made of two connected parts, wherein one part includes the reflecting surface, and the other part is made of a non-reflecting material and formfittingly engages with the reflecting surface. The sub-reflector is rotatably supported on the cylindrical shaft and has a rotation speed of between approximately 1500 to 3500 rpm.

17 Claims, 3 Drawing Sheets

REFLECTOR ANTENNA AND METHOD OF PRODUCING A SUB-REFLECTOR

CROSS-REFERENCES TO RELATED APPLICATIONS

This application claims the priority of German Patent Application Serial No. 199 52 819.5, filed Nov. 2, 1999, the subject matter of which is incorporated herein by reference.

BACKGROUND OF THE INVENTION

The present invention relates to a reflector antenna with a main reflector and a rotatable sub-reflector having a reflecting surface and located in front of the main reflector in the direction of the arriving beams. The invention is also related to a method for producing a sub-reflector for a reflector antenna.

A reflector antenna is typically used to receive electromagnetic beams emitted by a radiation source, such as a satellite, and transmit corresponding signals for amplification. The electromagnetic beams impinge on a main reflector which reflects the beams to a sub-reflector which is formed approximately at a focal point of a main antenna. The main antenna can be in the form of a dish. The sub-reflector includes a reflecting layer facing the main reflector which diverts the beams reflected by the main reflector to a receiver located in the center of the main reflector. To obtain the greatest possible cross-section of the sub-reflector, the sub-reflector rotates and is placed in the focal point of the main reflector. A typical rotation speed ranges from approximately 200 to 400 rpm. The sub-reflector is supported on a rotation axle located eccentrically relative to an axis extending through a center of the main reflector. The sub-reflector hereby scans the main reflector across a cone which opens from the sub-reflector towards the main reflector.

The eccentrically supported sub-reflector can produce undesirable vibrations which can cause the support of the sub-reflector to vibrate. The vibrations can interfere with the received signals. In a known solution for this problem, the sub-reflector rotates about its center of gravity on a rotation axis which extends substantially in the direction of the axis of the main reflector. However, the axis of the sub-reflector in this case is not parallel to the axis of the main reflector, whereby this deviation produces a vibration effect in the support of the sub-reflector. However, any vibration should not significantly affect the strength of the received signals within the rotation speed range in which the sub-reflector operates.

SUMMARY OF THE INVENTION

It is thus an object of the present invention to provide an improved reflector antenna, obviating the afore-stated drawbacks.

In particular, it is an object of the present invention to provide an improved reflector antenna which is so constructed as to eliminate vibration effects.

According to one aspect of the invention, a sub-reflector has a cylindrical shaft extending in a direction parallel to a main axis of the main reflector, wherein the sub-reflector is rotatably supported on the cylindrical shaft and rotates at a high rotation speed of between approximately 1500 to 3500 pm.

With this arrangement, the main reflector is rapidly scanned by the sub-reflected so that a large number of beams are received by the sub-reflector and reflected towards the receiver. This produces a strong signal in a circuit connected to the main reflector. Although the rotation axis is oriented in the same direction as the axis of the main reflector, the hyperbolic reflector surfaces of the reflector reflect a large number of beams towards the receiver.

According to another embodiment of the invention, the sub-reflector is supported on its shaft so as to be free from vibrations. To achieve this goal, the sub-reflector has to be supported on the shaft with high precision; moreover, the shape of the sub-reflector has to be suitably selected so that no vibrations are produced in the support even at a high rotation speed.

According to another embodiment of the invention, the sub-reflector is formed as a rotating body that is free from imbalances. This is difficult to achieve mechanically, because the reflecting surface has to reflect the received beams towards the receiver as perfectly as possible. This requirement has a major impact on the shape of the reflector, which adds to the mechanical complexity imposed by the requirement that the sub-reflector has to be supported vibration-free even at high rotation speed.

According to another embodiment of the invention, the rotating body is made of a solid material that does not reflect the electromagnetic beams, with a reflecting surface embedded in the non-reflecting solid material. The non-reflecting solid material provides the rotating body with a compact form which enables a vibration-free rotation even at a high rotation speed.

According to another embodiment, the solid material has the form of a cylinder and includes two parts connected with one another, wherein one of the parts includes on the end opposite the other part the reflecting surface, with the end of the other part formfittingly fits into the reflecting surface. With this arrangement, the reflecting surface does not produce an intrinsic motion, such as a wobbling motion. The reflecting surface is fixedly connected with the non-reflecting solid material on the one hand, and acted upon by the other part as a consequence of the configuration in the form of a rigid rotating body.

According to another embodiment of the invention, a reflective coating is applied to the non-reflecting solid material for forming the reflecting surface. This layer strongly adheres to the non-reflecting solid material and does not execute an intrinsic motion, for example a wobble, even at a high rotation speed.

According to another embodiment of the invention, the reflecting layer is made of an aluminum layer that is fixedly connected with the solid material. According to another embodiment, the aluminum layer can be applied to the non-reflecting solid material by evaporation.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
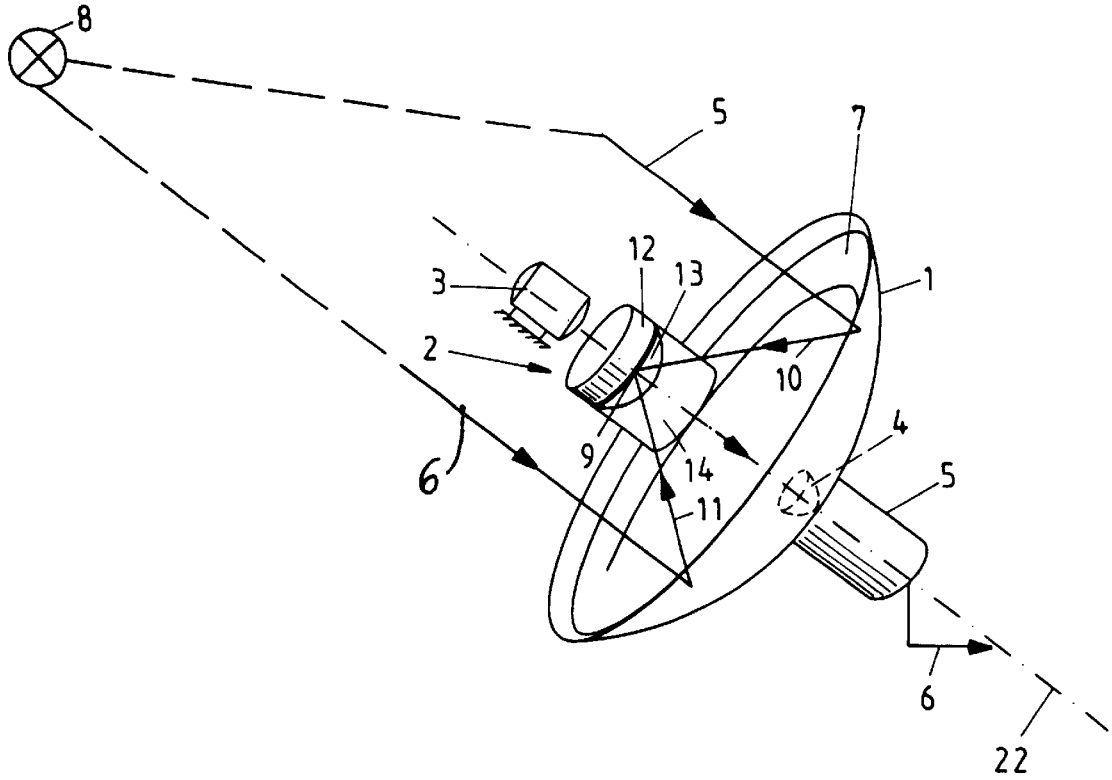
FIG. 1 is a three-dimensional diagram of essential elements of a reflector antenna.
Figure 4:
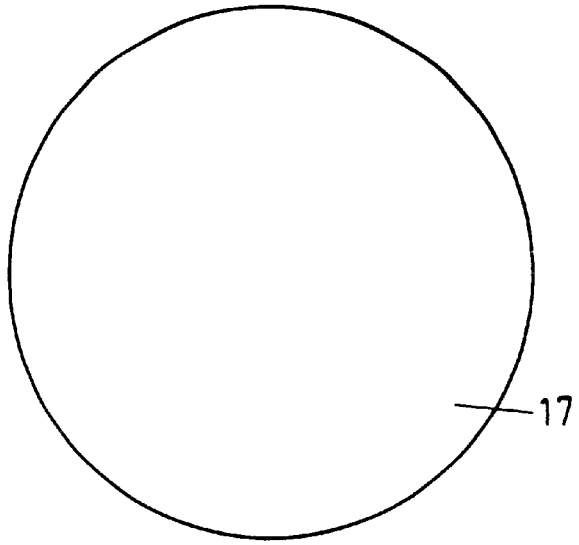
FIG. 4 is a base area of the element depicted in FIG. 3.
Figure 3:
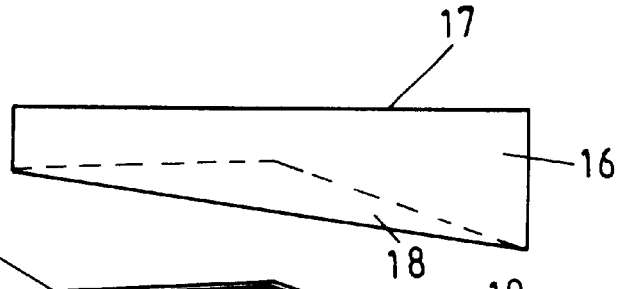
FIG. 3 is a side view of a second element of a reflector antenna of FIG. 1 with a reflecting layer.
Figure 2:
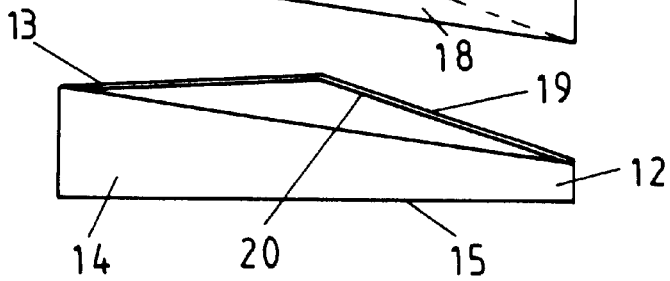
FIG. 2 is a side view of an element of the reflector antenna of FIG. 1 with a reflecting layer.
Figure 5:
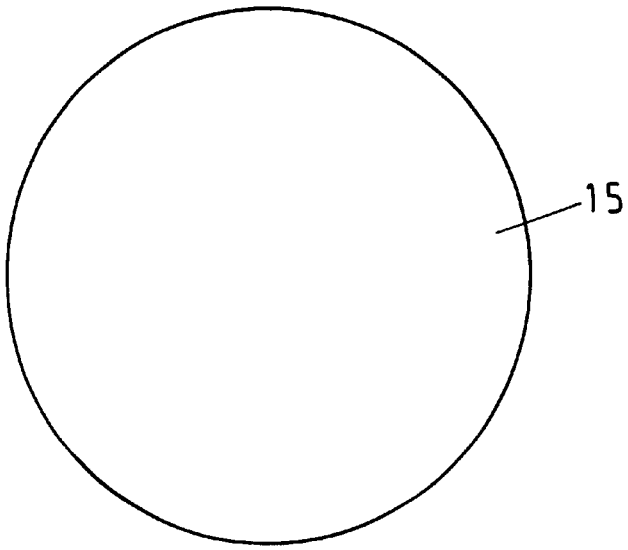
FIG. 5 is a base area of the element depicted in FIG. 2.
Figure 6:
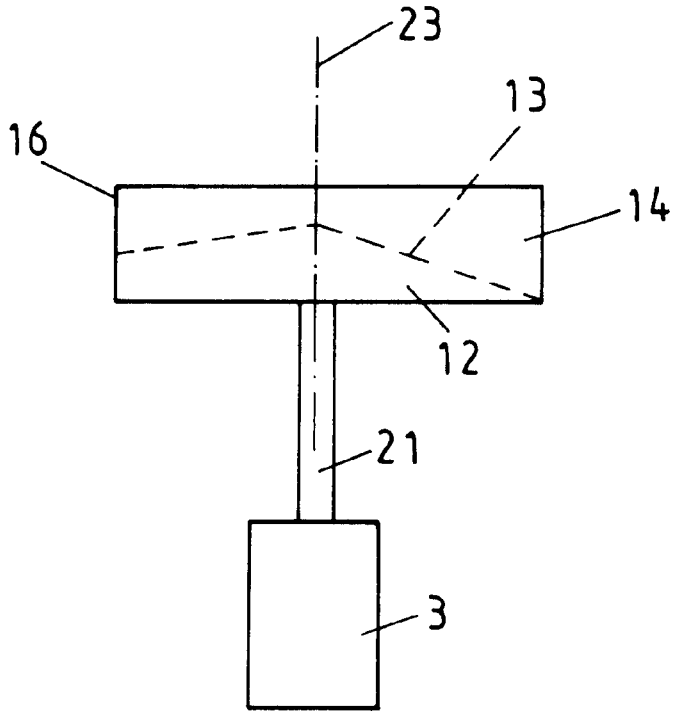
FIG. 6 is a side view of a sub-reflector fabricated from the two elements of FIGS. 2 and 3, with a motor driving the sub-reflector.

Throughout all the Figures, same or corresponding elements are generally indicated by same reference numerals.

Turning now to the drawing, and in particular to FIG. 1, there is shown a reflector antenna which includes essentially of a main reflector 1, a sub-reflector 2, a motor 3 driving the sub-reflector 2, a receiver 4, and a detector 5 that converts the received signals. The signals converted in the detector 5 can be routed onward via a cable 6 for further processing.

The main reflector 1 is essentially formed as a dish having a non-rotating parabolic inside surface 7. The dish can be installed on a frame (not shown) so as to be adjustable with respect to the position of a transmitter, for example a satellite 8.

A reflecting surface 13 of the sub-reflector 2 is disposed in a focal point 9 of all the beams 10, 11 that are reflected by the main reflector 1. The reflecting surface 13 is fixedly connected with a first element 12 of the sub-reflector. The first element 12 is formed as a part of a cylinder 14, wherein the boundary of the cylinder 14 facing away from the reflecting surface 13 is formed by a circular surface 15.

A second element 16 of the sub-reflector 2, which also has the shape of a cylinder with a circular surface 17 facing away from the first element 12, corresponds to the first element 12 of the cylinder 14. A recess 18 indicated by dashed lines and adapted to formfittingly receive the reflecting surface 13 of the first element 12 is formed in the second element 16. The assembled elements 12, 16 form a cylinder 14 that is bounded on both sides by circular surfaces 15, 17. The material of the two elements 12, 16 is selected so as to minimize reflection of electromagnetic waves having a short wavelength. Only the reflecting surface 13 is capable of reflecting towards the receiver 4 those beams 11 that are reflected by the main reflector 1.

For this purpose, the reflecting surface 13 is provided with a coating 19. The coating 19 can be made, for example, of a color paint coating or a foil which is applied to a support surface 20 disposed opposite the circular surface 15. The support surface 20 is formed so as to facilitate reflection of the beams 10, 11 towards the receiver 4. The support surface 20 can, for example, have a hyperbolic form. The applied coating 19 conforms to the support surface 20 and transforms the support surface 20 into the reflecting surface 13.

The recess 18 is formed as a paraboloid corresponding to the reflecting surface 13. The paraboloid should be carefully machined so that the reflecting surface 13 is formfittingly received in the recess 18. The fit should be adequate so that the two elements 12, 16 can be rigidly connected with one another by inserting the reflecting surface 13 into the recess and, for example, gluing the piece together, so that one element 12 is prevented from moving relative to the other element 16 even under a substantial external forces. As a result, the two elements 12, 16 do not move independently relative to one another even if the entire cylinder 14 is rotated with a high rotation speed.

The cylinder 14 including the motor 3 is supported with the help of a mechanical arrangement (not shown) in front of the main reflector 1 in a direction towards the radiation source 8. The motor 3 can rotate the cylinder 14 via a drive shaft 21. The cylinder 14 is arranged so that its center axis, around which the cylinder rotates, extends in a direction along a main axis 22 extending through the main reflector 1. A cylinder shaft 23 of cylinder 14 also extends in the direction of this main axis 22, so that both the drive shaft 21 and the cylinder shaft 23 extend in the direction of the main axis 22. In this way, the cylinder axis 23 does not deviate from the main axis 22, so that the driven cylinder 14 can be expected to run very smoothly.

Moreover, the cylinder 14 does not produce an imbalance that can cause the cylinder 14 to run rough. The cylinder 14 is made of a uniformly distributed material having a uniform specific density across the entire cylinder 14. The coating 19 applied to the support surface 20 has the same specific density as the cylinder 14. The cylinder 14 therefore does not introduce any imbalances in the rotating system. The assembly formed by the motor 3 and the sub-reflector 2 hence does not vibrate even at a high rotation speed. The beams 10, 11 reflected by sub-reflector 2 towards the receiver 4 hence produce in the detector 5 signals with an optimal strength.

The sub-reflector 2 can be produced by forming initially the two elements 12, 16, for example by machining or casting. In this way, the support surface 20 has an excellent snug fit with the recess 18.

A coating 19 is then to the support surface 20. Depending on the selected material, the coating can be applied, for example, as a color coating and can be either sprayed or brushed on the support surface 20. The so produced reflecting surface 13 is subsequently fitted into the recess 18 of the second element 16 and connected thereto. This connection can be implemented by using a thin layer of adhesive. As mentioned above, the adhesive should have the specific density of both the non-reflecting material and the coating 19.

An attachment point is provided on the first element 12 of the shaft 23 extending through the cylinder 14 for establishing a connection with the drive shaft 21 of the motor 3. Corresponding coupling elements can be connected to the second element 16 of the cylinder 14.

While the invention has been illustrated and described as embodied in a reflector antenna and method of producing a sub-reflector, it is not intended to be limited to the details shown since various modifications and structural changes may be made without departing in any way from the spirit of the present invention.

What is claimed is:

1. Reflector antenna adapted to receive electromagnetic radiation beams from a radiation source and including a main reflector and a rotatable sub-reflector, the sub-reflector comprising a reflecting surface located in front of the main reflector between the main reflector and the radiation source, and a cylindrical shaft extending in a direction parallel to a main axis of the main reflector and rotatably supporting the sub-reflector, wherein the sub-reflector is in the form of a rotationally symmetric body that is made of a non-reflecting solid material that does not reflect the electromagnetic radiation beams, and further comprises a reflecting surface embedded in the non-reflecting solid material, and wherein the non-reflecting solid material has the form of a cylinder and is made of two parts connected with one another, wherein an end of one part opposite the other part includes the reflecting surface, and an end of the other part formfittingly engages with the reflecting surface.

2. Reflector antenna according to claim 1, wherein the sub-reflector is supported on the cylindrical shaft so as to be free from vibrations.

3. Reflector antenna according to claim 1, wherein the sub-reflector is in the form of a rotationally symmetric body that is free from an imbalance.

4. Reflector antenna according to claim 1, wherein the reflecting surface has a hyperbolic cross-section which projects into a complementary recess of the other part.

5. Reflector antenna according to claim 1, wherein the reflecting surface is formed by applying a reflective coating to the non-reflecting solid material.

6. The reflector antenna according to claim 5, wherein the reflecting surface is a color coating.

7. Reflector antenna according to claim 5, wherein the reflecting surface is an aluminum layer.

8. The reflector antenna according to claim 7, wherein the aluminum layer is evaporated on the non-reflecting solid material.

9. Reflector antenna according to claim 5, wherein the reflecting surface has a specific density substantially identical to a specific density of the non-reflecting solid material.

10. Reflector antenna according to claim 5, wherein the reflecting surface has a specific density substantially identical to a specific density of the non-reflecting solid material.

11. Reflector antenna adapted to receive electromagnetic radiation beams from a radiation source and including a main reflector and a rotatable sub-reflector, the sub-reflector comprising a reflecting surface located in front of the main reflector between the main reflector and the radiation source, and a cylindrical shaft extending in a direction parallel to a main axis of the main reflector and rotatably supporting the sub-reflector, wherein the sub-reflector is in the form of a rotationally symmetric body that is made of a non-reflecting solid material that does not reflect the electromagnetic radiation beams, and further comprises a reflecting surface embedded in the non-reflecting solid material.

12. Reflector antenna according to claim 11, wherein the sub-reflector is supported on the cylindrical shaft so as to be free from vibrations.

13. Reflector antenna according to claims 11, wherein the sub-reflector is in the form of a rotationally symmetric body that is free from an imbalance.

14. Reflector antenna according to claim 11, wherein the reflecting surface has a hyperbolic cross-section.

15. Reflector antenna according to claim 14, wherein the reflecting surface is a color surface.

16. Reflector antenna according to claim 14, wherein the reflecting surface is an aluminum surface.

17. A method for fabricating a sub-reflector for a reflector antenna, comprising:

providing two substantially cylindrical parts of a non-reflecting solid material, with a first cylindrical part bounded by a circular surface and by a hyperbolic surface that is coated with a reflecting coating, and with a second cylindrical part bounded by a parabolic surface;

fitting the parabolic surface into the hyperbolic surface; and fixedly connecting the parabolic surface which the hyperbolic surface.

* * * * *